US008040057B2

(12) United States Patent
Kim

(10) Patent No.: US 8,040,057 B2
(45) Date of Patent: Oct. 18, 2011

(54) DISPLAY PANEL HAVING A CONTACT ANGLE BETWEEN THE SUBSTRATE AND ELECTRODE

(75) Inventor: Dohwan Kim, Cheongju-si (KR)

(73) Assignee: LG Electronics Inc., Seoul (KR)

( * ) Notice: Subject to any disclaimer, the term of this patent is extended or adjusted under 35 U.S.C. 154(b) by 147 days.

(21) Appl. No.: 12/532,504

(22) PCT Filed: Dec. 31, 2007

(86) PCT No.: PCT/KR2007/007056

§ 371 (c)(1),
(2), (4) Date: Sep. 22, 2009

(87) PCT Pub. No.: WO2008/117919

PCT Pub. Date: Oct. 2, 2008

(65) Prior Publication Data

US 2010/0134002 A1 Jun. 3, 2010

(30) Foreign Application Priority Data

Mar. 23, 2007 (KR) ..... 10-2007-0028836

(51) Int. Cl.
*H01J 63/04* (2006.01)
*H01J 1/62* (2006.01)

(52) U.S. Cl. ..... 313/506; 313/483; 313/500; 313/501

(58) Field of Classification Search ..... None
See application file for complete search history.

(56) References Cited

U.S. PATENT DOCUMENTS

| | | | | |
|---|---|---|---|---|
| 6,808,435 | B2 * | 10/2004 | Hayashi et al. | 445/24 |
| 2005/0041001 | A1 * | 2/2005 | Sumida et al. | 345/60 |
| 2009/0190078 | A1 * | 7/2009 | Mikami et al. | 349/137 |

FOREIGN PATENT DOCUMENTS

| | | |
|---|---|---|
| JP | 2001-216892 | 8/2001 |
| JP | 2003-051258 | 2/2003 |
| JP | 2005-158295 | 6/2005 |
| KR | 10-2006-0062699 | 6/2006 |

OTHER PUBLICATIONS

International Search Report dated Apr. 14, 2008.
Korean Office Action dated Dec. 11, 2007.

* cited by examiner

*Primary Examiner* — Natalie K Walford
(74) *Attorney, Agent, or Firm* — Ked & Associates, LLP

(57) ABSTRACT

A display panel includes a substrate and an electrode disposed on the substrate. A contact angle θ between the substrate and the electrode is expressed by the following Equation 1: arc tangent(T/S)≦θ≦arc tangent(40T/S) (S: surface area of electrode cross section, T: peak height of electrode cross section).

18 Claims, 5 Drawing Sheets

[Fig. 1]
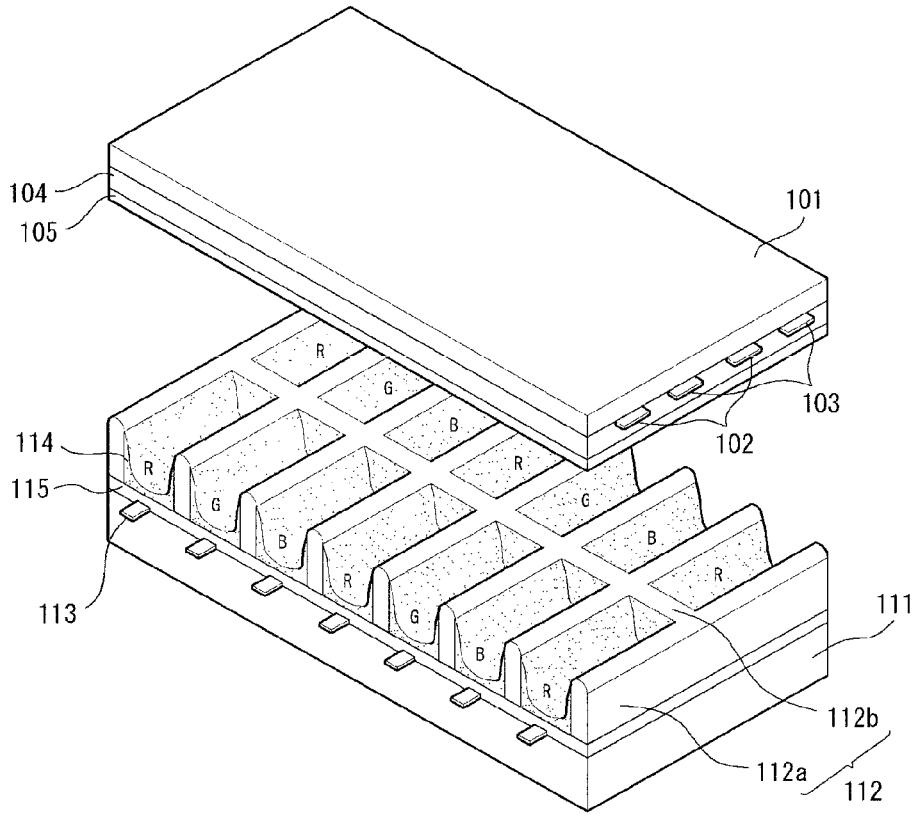
[Fig. 2]
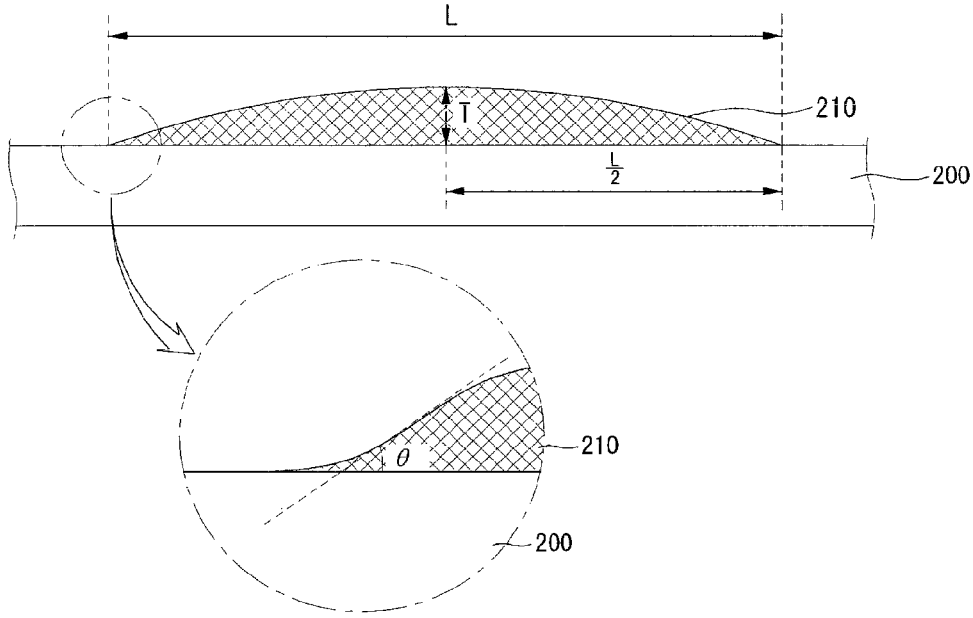

[Fig. 3]
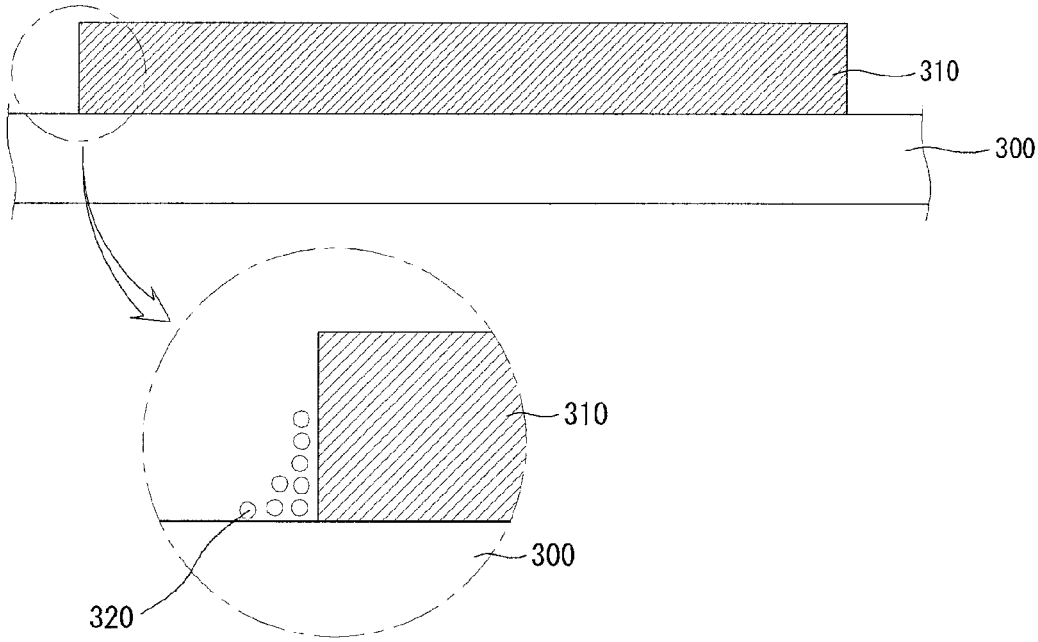
[Fig. 4]
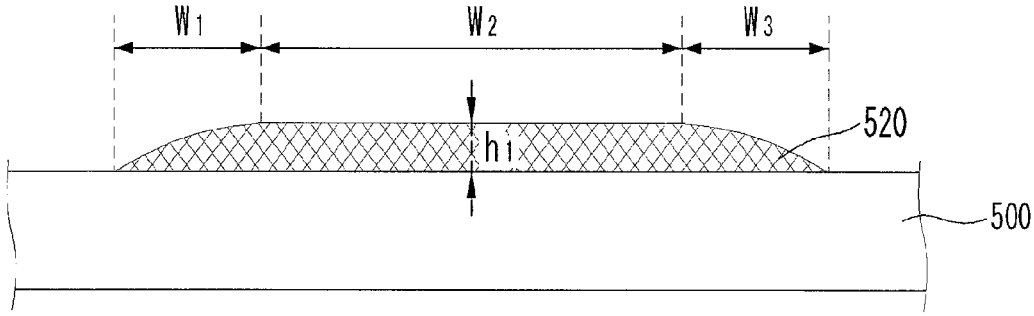
[Fig. 5]
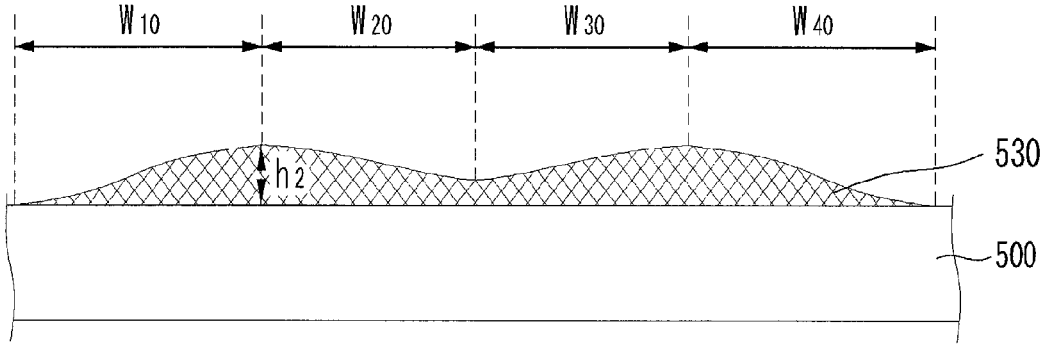

[Fig. 6]
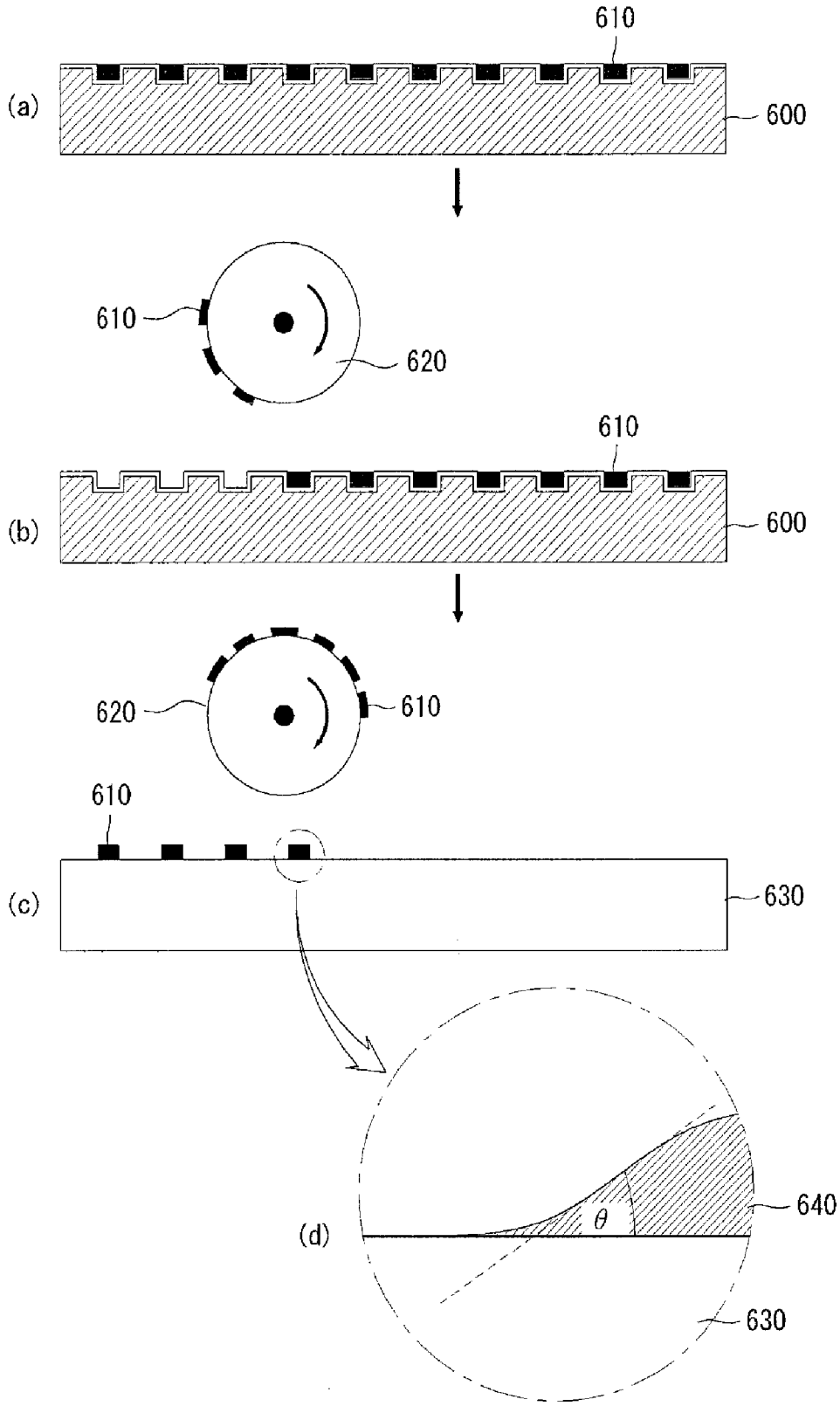

[Fig. 7]
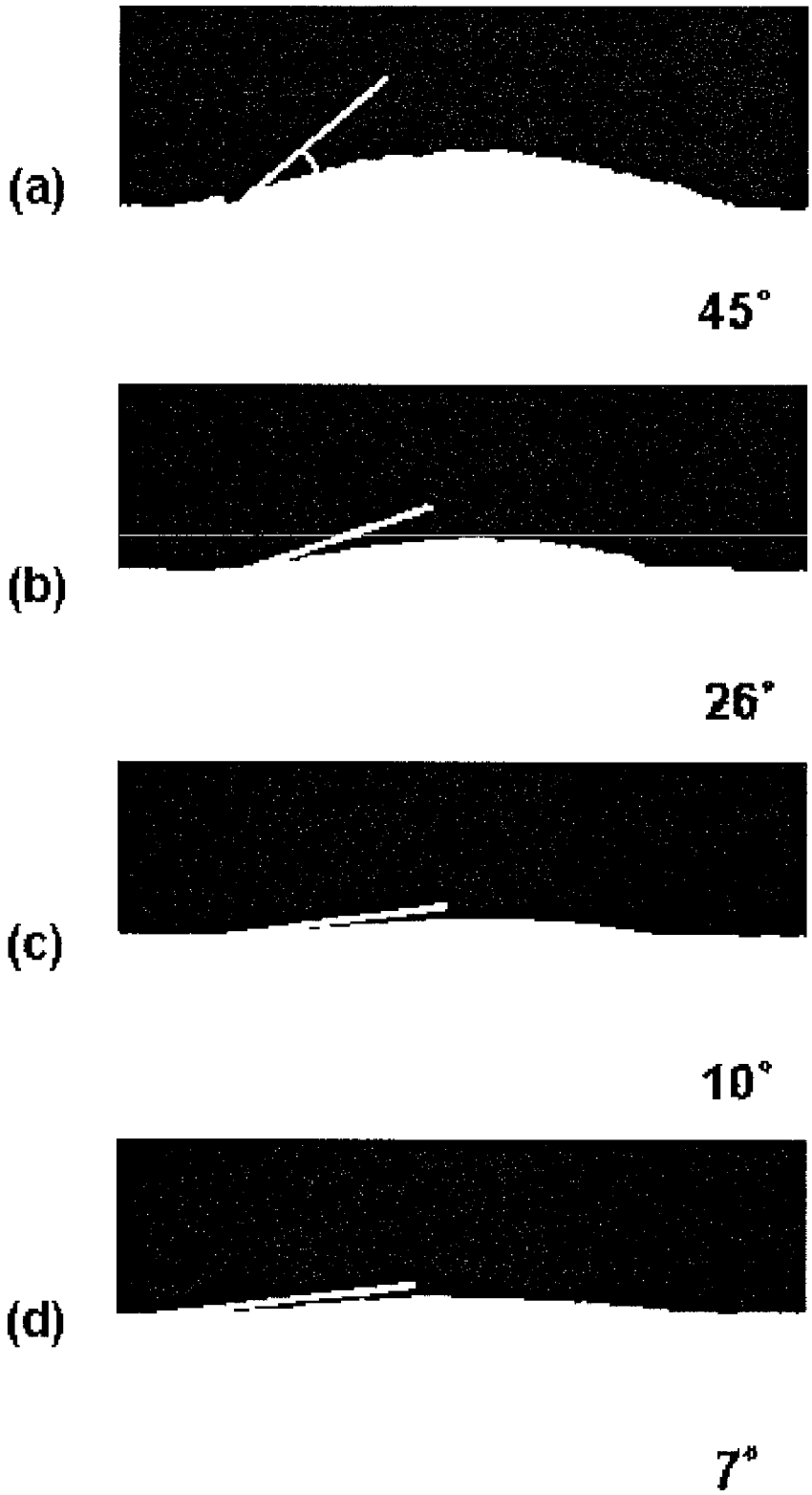

[Fig. 8]
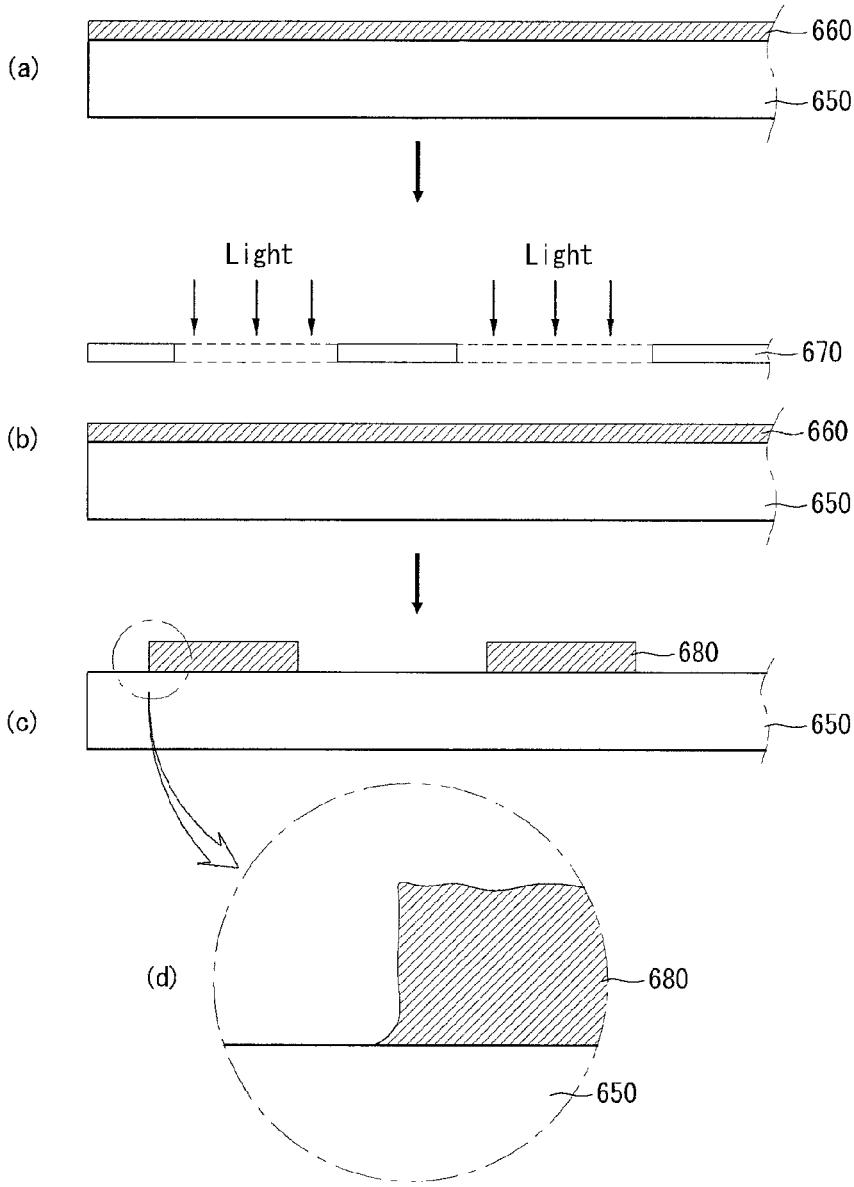
[Fig. 9]
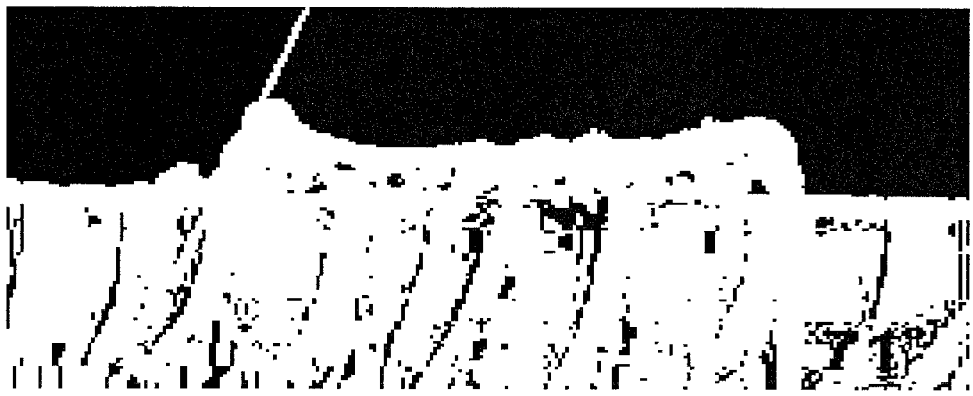

DISPLAY PANEL HAVING A CONTACT ANGLE BETWEEN THE SUBSTRATE AND ELECTRODE

TECHNICAL FIELD

This document relates to a display panel.

BACKGROUND ART

Display panels displaying an image on a screen are of a kind, such as Liquid Crystal Display (LCD), Field Emission Display (FED), Organic Light Emitting Display (OLED), and Plasma Display Panel (PDP).

DISCLOSURE OF INVENTION

BRIEF DESCRIPTION OF THE DRAWINGS

FIG. 1 is a diagram illustrating an example of a plasma display panel;

FIG. 2 is a diagram illustrating in more detail an electrode of a display panel;

FIG. 3 is a diagram illustrating an example of a case where a contact angle between a substrate and an electrode is relatively large;

FIGS. 4 and 5 are diagrams illustrating an example of another shape of an electrode; and FIGS. 6 to 9 are diagrams illustrating an example of a method for manufacturing an electrode.

MODE FOR THE INVENTION

Display panels, for example, plasma display panels will be described below, however, display panels are not limited to plasma display panels but can be also LCDs, FEDs, and OLEDs.

FIG. 1 is a diagram illustrating an example of a plasma display panel.

Referring to FIG. 1, the plasma display panel is formed by sealing a front substrate 101 and a rear substrate 111. In the front substrate 101, a scan electrode 102 and a sustain electrode 103 are disposed to be in parallel with each other. The rear substrate 111 is disposed to face the front substrate 101. In the rear substrate 111, an address electrode 113 is disposed to intersect with the scan electrode 102 and the sustain electrode 103.

An upper dielectric layer 104 covering the scan electrode 102 and the sustain electrode 103 may be disposed on the front substrate 101 where the scan electrode 102 and the sustain electrode 103 are disposed.

The upper dielectric layer 104 can limit a discharge current of the scan electrode 102 and the sustain electrode 103 and insulate the scan electrode 102 and the sustain electrode 103.

A protective layer 105 may be disposed on the upper dielectric layer 104 to facilitate a discharge condition. The protective layer 105 may comprises materials having a high secondary electron emission factor, for example, magnesium oxide (MgO).

Electrode, for example, the address electrode 113 is disposed at the rear substrate 111. A dielectric layer, for example, a lower dielectric layer 115 to cover the address electrode 113 and insulate the address electrode may be disposed at the rear substrate 111 where the address electrode 113 is disposed.

A barrier rib 112 of a stripe type, a well type, a delta type, and a honeycomb type may be disposed between the front substrate 101 and the rear substrate 111 to partition a discharge space, that is, a discharge cell. Such a barrier rib 112 may allow provision of Red (R), Green (G), and Blue (B) discharge cells between the front substrate 101 and the rear substrate 111.

As shown in FIG. 1, in a closed type barrier rib structure, the barrier rib 112 can comprise a first barrier rib 112*b* and a second barrier rib 112*a* intersecting with each other.

In addition to the barrier rib 112 shown in FIG. 1, various structures of barrier ribs may be also provided. For example, the first barrier rib 112*b* and the second barrier rib 112*a* may be different from each other in height.

Discharge gas is filed in discharge cells partitioned by the barrier rib 112. Also, a phosphor layer 114, for example, R, G, B phosphor layers may be disposed within the discharge cells partitioned by the barrier rib 112 to emit visible rays for displaying an image upon address discharge.

The above is a description for only an example of the plasma display panel to which the present invention is applicable. The present invention is not limited to the plasma display panel of the above-described structure. For example, the above is a description for only a case where the scan electrode 102 and the sustain electrode 103 are disposed to be in contact with a top surface of the front substrate 101. Unlike this, at least one functional layer, for example, another dielectric layer may be also further disposed between the front substrate 101 and the scan electrode 102 and the sustain electrode 103.

FIG. 2 is a diagram illustrating in more detail an electrode of a display panel. The electrode 210 of FIG. 2 may be at least one of the scan electrode 102, the sustain electrode 103, and the address electrode 113 of FIG. 1.

Referring to FIG. 2, the electrode 210 is disposed on a substrate 200. A contact angle (θ) between the electrode 210 and the substrate 200 is gently made on a contact surface between the electrode 210 and the substrate 200.

More preferably, assuming that a surface area of a cross section of the electrode 210 disposed on the substrate 200 is denoted by "S" and a peak height of the cross section is denoted by "T" the contact angle (θ) between the electrode 210 and the substrate 200 is expressed by the following equation 1:

$$\text{arc tangent}\,(T/S) \leqq \theta \leqq \text{arc tangent}\,(40T/S) \qquad \text{[Equation 1]}$$

where

S: surface area of electrode cross section, and

T: peak height of electrode cross section.

A unit of the surface area (S) of the electrode cross section can be $\mu m^2$, and a unit of the peak height of the electrode cross section can be μm. The electrode cross section is a cross section in a length direction.

According to the above equation 1, a shape of the cross section of the electrode 210 may be convex-shape in the reverse direction of the direction where the substrate 200 is disposed.

It is desirable that the peak height (T) of the cross section of the electrode 210 is a height of the electrode 210 at L/2 when a length of the cross section of the electrode 210 is "L"

The contact angle (θ) between the electrode 210 and the substrate 200 can be expressed in the following equation 2:

$$\text{arc tangent}\,(2T/S) \leqq \theta \leqq \text{arc tangent}\,(20T/S). \qquad \text{[Equation 2]}$$

As above, the reason why the contact angle (θ) between the electrode 210 and the substrate 200 is made between arc tangent (T/S) and arc tangent (40T/S) or between arc tangent (2T/S) and arc tangent (20T/S) will be described below with reference to FIG. 3.

FIG. 3 is a diagram illustrating an example of a case where a contact angle (θ) between a substrate and an electrode is relatively large.

Referring to FIG. 3, unlike the shape of the electrode of the display panel according to the present invention, a contact angle (θ) between a substrate 300 and an electrode 310 is relatively large.

Here, it will be assumed that a functional layer, for example, a dielectric layer covering an electrode 310 on the substrate 300 is further formed.

A space near an end portion of the electrode 310 may not be sufficiently filed with a dielectric material constituting a dielectric layer because the contact angle (θ) between the substrate 300 and the electrode 310 is relatively large in FIG. 3.

If so, predetermined gas or moisture, etc. is entrapped and thus, gas bubbles 320 may rise from a space between the substrate 300 and the electrode 310. The gas bubbles 320 may increase a resistance value of the electrode 310, reducing a driving efficiency of a display panel. What is worse, the gas bubbles 320 may also cause an electric breakdown of the electrode 310 upon driving.

On the other hand, in a case that the contact angle (θ) between the substrate 200 and the electrode 210 has a sufficiently small value equal to or less than arc tangent (40T/S) as in FIG. 2, the dielectric material may be more easily filled in a space near end portion of the electrode 210. Accordingly, unlike FIG. 3, the generation of gas bubbles can be prevented.

Table 1

TABLE 1

| Contact angle (θ) | Generation of the gas bubbles |
|---|---|
| arc tangent (T/S) | X |
| arc tangent (10T/S) | X |
| arc tangent (20T/S) | X |
| arc tangent (30T/S) | X |
| arc tangent (35T/S) | X |
| arc tangent (38T/S) | X |
| arc tangent (40T/S) | X |
| arc tangent (41T/S) | 0 |
| arc tangent (45T/S) | 0 |

Table 1 shows observation data on generation or non-generation of gas bubbles depending on a contact angle between a substrate and an electrode. In more detail, Table 1 shows observation data on generation or non-generation of the gas bubbles in the dielectric layer formed to cover the electrode depending on a variation of the contact angle (θ) between the substrate and the electrode from arc tangent (T/S) to arc tangent (45T/S). Here, a mark "X" indicates a good state because gas bubbles are not generated, and a mark "0" indicates a poor state because gas bubbles are generated.

Referring to Table 1, it can be appreciated that in a case where the contact angle (θ) between the substrate and the electrode is within a range of arc tangent (T/S) to arc tangent (40T/S), gas bubbles are not generated because the contact angle (θ) between the substrate and the electrode is sufficiently small.

On the other hand, it can be appreciated that in a case where the contact angle (θ) between the substrate and the electrode is more than or equal to arc tangent (40T/S), gas bubbles are generated because the contact angle (θ) between the substrate and the electrode is excessively large.

In a case where a viscosity of electrode material for forming electrode is greater, generation of gas bubbles can more increase when the contact angle (θ) between the substrate and the electrode is more than or equal to arc tangent (45T/S).

Accordingly, it is desirable that the contact angle (θ) between the substrate and the electrode is made below arc tangent (40T/S) to prevent a reduction of driving efficiency and an electric breakdown of electrode caused by generation of gas bubbles.

An excessive reduction of the contact angle (θ) between the substrate and the electrode may lead to an undue reduction of a surface area of a cross section of the electrode. This may increase an electrical resistance value of the electrode, reducing a driving efficiency.

An excessive reduction of the contact angle (θ) between the substrate and the electrode causes a difficulty in an electrode manufacturing process and requires a more precise control of manufacturing process.

Thus, it is desirable that the contact angle (θ) between the substrate and the electrode is within a range of arc tangent (T/S) to arc tangent (40T/S). It is more desirable that the contact angle (θ) between the substrate and the electrode is within a range of arc tangent (2T/S) to arc tangent (20T/S) in consideration of manufacturing process, gas bubbles, electrical resistance, etc.

An excessive increase of an electrical resistance value of the electrode of the display panel according to the present invention can cause a reduction of a driving efficiency at the time of display panel driving. Thus, it is required to sufficiently reduce an electrical resistance value of the electrode so as to avoid reducing the driving efficiency.

The electrical resistance value of the electrode of the display panel according to the present invention is not limited specifically, but it is desirable that the electrical resistance value of the electrode is within a range of about 30 W to 70 W to guarantee a sufficiently high driving efficiency upon driving.

The electrode 210 of FIG. 2 is not specifically limited in shape excepting that the contact angle (θ) between the substrate 200 and the electrode 210 is within a range of arc tangent (T/S) to arc tangent (40T/S), but the length (L) of the cross section of the electrode 210 and the peak height (T) of the cross section can be decided in consideration of electrical resistance, manufacturing process, etc.

For example, an undue decrease of the length (L) of the cross section of the electrode 210 compared to the peak height (T) of the cross section causes an undue decrease of the surface area of the cross section of the electrode 210, excessively increasing the electrical resistance value or excessively increasing the contact angle (θ) between the substrate 200 and the electrode 210. On contrary, an excessive increase of the length (L) of the cross section of the electrode 210 compared to the peak height (T) of the cross section leads to an increase of a possibility where a phenomenon of electrical short between two adjacent electrode material lines happens due to a fluidity of electrode material, when the electrode 210 is manufactured.

Thus, it is desirable that the length (L) of the cross section of the electrode 210 is 6 times to 48 times the peak height (T) of the cross section, more desirably, the length (L) of the cross section of the electrode 210 is 11 times to 22 times the peak height (T) of the cross section.

It is desirable that the length (L) of the cross section of the electrode 210 is within a range of about 60 μm to 90 μm and that the peak height of the cross section of the electrode 210 is within a range of about 3 μm to 10 μm.

In view of data on the length (L) of the cross section of the electrode 210 and the peak height (T) of the cross section, it is desirable that the contact angle (θ) between the substrate 200 and the electrode 210 is within a range of about 3° to 45°, more desirably, about 5° to 30° to allow the contact angle (θ) to be within a range of arc tangent (T/S) to arc tangent (40T/S).

FIGS. 4 and 5 are diagrams illustrating an example of another shape of an electrode.

Referring to FIG. 4, a height (h1) of a cross section of an electrode 520 disposed on a substrate 500 can gradually increase in a W1 region while being substantially constantly maintained in a W2 region and gradually decreasing in a W3 region.

Alternately, as shown in FIG. 5, a height (h2) of a cross section of an electrode 530 disposed on the substrate 500 can gradually increase in a W10 region while gradually decreasing in a W20 region, again gradually increasing in a W30 region, and again gradually decreasing in a W40 region.

Under the condition satisfying that a contact angle (θ) between a substrate and an electrode is within a range of arc tangent (T/S) to arc tangent (40T/S) as above, a shape of the electrode can change.

FIGS. 6 to 9 are diagrams illustrating an example of a method for manufacturing an electrode.

FIG. 6 illustrates an offset process that is an example of a direct patterning process. Here, FIG. 6 illustrates only the offset process that is an example of the direct pattern process, but the direct patterning process can comprise various methods such as a print method.

Referring to FIG. 6, in (a), an electrode material 610 of a paste state or a slurry state is coated on a surface of a mold 600.

In (b), a blanket 620 is moved on the surface of the mold 600 coated with the electrode material 610. Thus, the electrode material 610 is stuck to a surface of the blanket 620.

It is desirable that the blanket 620 is of a roller type such that the electrode material 610 is more effectively stuck to the blanket 620. In a case where the blanket 620 is of the roller type, the blanket 620 can be rolled on the surface of the mold 600 while the electrode material 610 being stuck.

In (c), the blanket 620 to which the electrode material 610 is stuck moves on a substrate 630 for display panel manufacturing while the electrode material 610 stuck to the surface of the blanket 620 is printed on the substrate 630.

In (d), an electrode 640 can be formed on the substrate 630 if a sintering or dry process is performed.

A contact angle (θ) between the electrode 640 formed after the sintering or dry process as above and the substrate 630 can be made within a range of arc tangent (T/S) to arc tangent (40T/S) due to a surface tension effect because the electrode material 610 of the paste state or the slurry state with fluidity is directly printed on the substrate 630. Also, a shape of the electrode 610 can be convex-shape.

An example of an electrode manufactured in a method of FIG. 6 is shown in FIG. 7.

Referring to FIG. 7, as shown in (a), the electrode is formed to have convex-shape and its contact angle (θ) with a substrate is approximately 45°.

Alternately, as shown in (b), a contact angle between a substrate and an electrode can be approximately 26°.

Alternately, as shown in (c), a contact angle between a substrate and an electrode can be approximately 10°.

Alternately, as shown in (d), a contact angle between a substrate and an electrode can be approximately 7°.

FIG. 8 shows an example of a method for forming an electrode in a photosensitive method without using a direct print method.

Referring to FIG. 8, as shown in (a), a substrate 650 for display panel manufacturing is coated with an electrode material 660.

For example, in (a), an electrode material of a paste state or a slurry state that is a combination of metal material with other material such as solvent and binder is coated on a screen mask and then, is pressed by a squeezer such that the electrode material on the screen mask can be coated on the substrate 650 through a hole provided in the screen mask.

As shown in (b), a photo mask 670 patterned is disposed over the substrate 650 coated with the electrode material 660, and light such as ultraviolet rays is irradiated into the electrode material 660 through the patterned mask 670 to cure part of the electrode material 660. This is called an exposure process.

After that, the electrode material 660 irradiated with a predetermined light is developed using a developer. This is called a development process.

After the development process, if a dry or sintering process is performed, an electrode 680 with a predetermined pattern can be formed on the substrate 650 as shown in (c).

A contact angle between the electrode 680 and the substrate 650 in FIG. 8 is relatively larger than that of FIG. 6 because the electrode 680 is formed using the exposure and development processes.

A comparison of the offset process of FIG. 6 with the photosensitive process of FIG. 8 will be made below. The photosensitive process of FIG. 8 requires a screen-printing process, an exposure process, and a development process. On the other hand, the offset process of FIG. 6 requires only a process of moving the blanket on the substrate to form the electrode. Thus, the offset process of FIG. 6 can reduce the number of manufacturing processes and a time taken for a manufacturing process compared to the photosensitive process of FIG. 8, decreasing a manufacturing cost relatively.

If the electrode is formed using the offset process of FIG. 6, the contact angle (θ) between the substrate and the electrode can be made within a range of arc tangent (T/S) to arc tangent (40T/S), but if the electrode is formed using the photosensitive process of FIG. 5C, the contact angle (θ) between the substrate and the electrode increases excessively.

In a case where the electrode is formed using the method of FIG. 8, it is not impossible that the contact angle (θ) between the substrate and the electrode is made within a range of arc tangent (T/S) to arc tangent (40T/S). However, this is disadvantageous in that this may require an additional etching process, increasing a manufacturing cost and furthermore, may rapidly increase the manufacturing cost because a precision of an exposure process or a development process has to more increase to make the contact angle (θ) between the substrate and the electrode within a range of arc tangent (T/S) to arc tangent (40T/S).

An example of an electrode manufactured in the method of FIG. 8 is shown in FIG. 9.

Referring to FIG. 9, an angle of a slope surface of an electrode manufactured using the photosensitive process is relatively larger. For example, a contact angle between an electrode and a substrate is approximately 71°.

An electrode composition used for manufacturing the above-described electrode of the display panel according to the present invention will be described with reference to Tables 2 and 3 below. It is desirable that the electrode composition noted in Tables 2 and 3 is used in the offset process of FIG. 6.

Table 2

TABLE 2

| Component | Metal powder | Binder | Organic solvent | Glass Frit |
|---|---|---|---|---|
| Range | 60-95 | 5-40 | 1-30 | 1-20 |

Referring to Table 2, it is desirable that, assuming that the electrode composition mixed is 100 parts by weight, the electrode composition used for manufacturing the electrode of the display panel comprises 60 to 95 parts by weight of metal powder, 5 to 40 parts by weight of binder, 1 to 30 parts by weight solvent, and 1 to 20 parts by weight glass frit.

The metal powder, a component for allowing an electrical conductivity of the electrode, is not limited specifically as long as it is material with electrical conductivity. However, considering offset print's workability and high electrical conductivity, it is desirable that the metal powder is at least one selected from the group of consisting of silver (Ag), copper (Cu), aluminum (Al), and gold (Au).

An excessive increase of a metal powder content may cause an undue reduction of a fluidity of an electrode material used for offset print. Thus, a length of a cross section of an electrode formed after sintering or dry may be subjected to an undue reduction compared to a height. On the other hand, an undue decrease of the metal powder content may cause an excessive increase of an electrical resistance value of an electrode formed after sinterings or dry. Accordingly, it is desirable that the metal powder content is within a range of 60 to 95 parts by weight.

The binder is not limited specifically, but desirably, the binder is any one of acrylate-based binder and metaacrylate-based binder or is a mixture of acrylate-based binder and metaacrylate-based binder in consideration of a manufacturing cost.

An excessive increase of binder content may cause an undue reduction of a fluidity of an electrode material used for offset print. On contrary, an undue decrease of the binder content may cause an excessive increase of the fluidity of the electrode material, causing a difficulty in shaping an electrode, such as mixing two adjacent electrode material lines at the time of offset print.

Accordingly, the binder content may be lie substantially in a range between 5 and 40 parts by weight.

The organic solvent is not limited specifically, but can use toluene, texanol, etc. in consideration of solubility, manufacturing cost, etc.

An excessive increase of organic solvent content may cause an excessive increase of a fluidity of an electrode material used for offset print. On contrary, an undue decrease of the organic solvent content may cause an undue decrease of the fluidity of the electrode material used for offset print. Accordingly, it is desirable that the organic solvent content is within a range of 1 to 30 parts by weight.

The glass frit, powder comprising a glass component, is solved upon sintering such that a shape of an electrode is maintained and the electrode has a sufficient strength. The glass frit comprised in the electrode composition according to the present invention has Tg of about 460° C. and Ts of about 495° C. to facilitate electrode shaping.

An excessive increase of glass frit content may cause an excessive increase of a dielectric constant of the electrode and an electrical resistance, reducing a driving efficiency of a display panel. On contrary, an undue decrease of the glass frit content makes it difficult for the electrode to have a shape of FIG. 2, causing undue weakening of electrode strength. Accordingly, it is desirable that the glass frit content is within a range of 1 to 20 parts by weight.

Table 3

TABLE 3

| Component | Metal powder | Binder | Organic solvent | Glass Frit | Additive |
|---|---|---|---|---|---|
| Range | 60-95 | 5-40 | 1-30 | 1-20 | 0.5-15 |

Referring to Table 3, an electrode composition used for an offset print process further comprises 0.5 to 15 parts by weight of distribution stabilizer as an additive as well as a metal powder, a binder, an organic solvent, and a glass frit.

The distribution stabilizer can uniformly distribute the metal powder and the glass frit in an electrode material of a paste state or slurry state.

The distribution stabilizer is not limited specifically, but can be any one of xylene, butyl acetate, and methoxy propyl acetate.

If an electrode material of a paste state or slurry state is formed by mixing components noted in Tables 2 and 3, and an electrode is formed in an offset process using the electrode material, the above-described condition where the contact angle (θ) between the substrate and the electrode is within a range of arc tangent (T/S) to arc tangent (40T/S) can be easily satisfied.

The glass frit will be described in more detail with reference to Tables 4 and 5.

Table 4

TABLE 4

| Component | $Bi_2O_3$ | $B_2O_3$ | $SiO_2$ | $Al_2O_3$ |
|---|---|---|---|---|
| Range | 33-69 | 9-36 | 1-19 | 1-18 |

Referring to Table 4, the glass frit can comprise 33 to 69 parts by weight of $Bi_2O_3$, 9 to 36 parts by weight of $B_2O_3$, 1 to 19 parts by weight of $SiO_2$, and 1 to 18 parts by weight of $Al_20_3$ on the basis of 100 parts by weight.

$Bi_2O_3$, a key component of the glass frit, improves a reaction of the glass frit, facilitating shaping of an electrode when the electrode is manufactured. An excessive increase of $Bi_2O_3$ content may cause a reduction of a strength of an electrode when the electrode is manufactured. A decrease of $Bi_2O_3$ content may cause a difficulty in shaping an electrode. Accordingly, it is desirable that $Bi_2O_3$ content is within a range of 33 to 69 parts by weight.

$B_2O_3$ can improve a fusibility of the glass frit. An excessive increase of $B_2O_3$ content may cause an undue decrease of a thermal expansion factor of the glass frit. An undue decrease of $B_2O_3$ content may lead to an undue reduction of the fusibility of the glass frit. Accordingly, it is desirable that $B_2O_3$ content is within a range of 9 to 36 parts by weight.

$SiO_2$ can increase a strength of an electrode when the electrode is manufactured. An excessive increase of $SiO_2$ content may lead to an undue decrease of a thermal expansion factor of the glass frit. An undue decrease of $SiO_2$ content may lead to an undue reduction of a heat resistance. Accordingly, it is desirable that $SiO_2$ content is within a range of 1 to 19 parts by weight.

$Al_20_3$ can increase a transition temperature of the glass frit, improving a heat resistance. An excessive increase of $Al_20_3$ content may lead to an undue reduction of a fusibility of the glass frit. An undue decrease of $Al_20_3$ content may cause a reduction of a heat resistance. Accordingly, it is desirable that $Al_20_3$ content is within a range of 1 to 18 parts by weight.

Table 5

TABLE 5

| Component | $Bi_2O_3$ | $N_2O_3$ | $SiO_2$ | $Al_2O_3$ | BaO | CaO | ZnO |
|---|---|---|---|---|---|---|---|
| Range | 33-69 | 9-36 | 1-19 | 1-18 | 0.5-20 | 0.5-9 | 0.5-14 |

Referring to Table 5, the glass frit further comprises 0.5 to 20 parts by weight of BaO, 0.5 to 9 parts by weight of CaO, 0.5 to 14 parts by weight of ZnO.

BaO, an unessential factor, can reduce a viscosity, promoting fusion at the time of fusing the glass frit. An excessive increase of BaO content may cause an undue decrease of a strength of a manufactured electrode. Accordingly, it is desirable that BaO content is within a range of 0.5 to 20 parts by weight.

CaO, an unessential factor, can reduce a viscosity, promoting fusion at the time of fusing the glass frit. An excessive increase of CaO content may cause an undue decrease of a strength of a manufactured electrode. Accordingly, it is desirable that CaO content is within a range of 0.5 to 9 parts by weight.

ZnO, an unessential factor, can be comprised within a range of 0.5 to 14 parts by weight to improve a fusibility of the glass frit.

A comparative example and an exemplary embodiment of the present invention will be compared and described with reference to Table 6 below.

Table 6

TABLE 6

| Component | Metal Powder | Binder | Organic Solvent | Glass Frit | Additive | Length of cross section | Peak height of croo section |
|---|---|---|---|---|---|---|---|
| Comparative example 1 | 48 | 8 | 39 | 3 | 2 | 112.4 | 2.8 |
| Comparative example 2 | 92 | 5 | 0.5 | 2 | 0.5 | 59 | 8.4 |
| Embodiment 1 | 70 | 18 | 4 | 6 | 2 | 82.3 | 5.6 |
| Embodiment 2 | 80 | 8 | 5 | 5 | 2 | 80.1 | 5.4 |
| Embodiment 3 | 85 | 5 | 5 | 3 | 2 | 79.7 | 5.9 |

In Table 6, respective components are mixed depending on noted content to form an electrode paste, and the formed electrode paste is printed in an offset print method to form an electrode.

Here, silver (Ag) material is used as the metal powder.

A characteristic of metal powder of the used silver (Ag) material is as follows.

The Ag material comprises D10 wherein a gain size of powder particle is within a range of about 0.05 μm to 0.5 μm, D50 wherein a gain size is within a range of about 0.2 μM to 0.9 μm, D90 wherein a gain size is within a range of about 0.5 μm to 2.0 μm, and D100 wherein a gain size is less than 5 μm.

A tap density of metal powders of Ag material is within a range of about 2.0 g/cm$^3$ to 5.5 g/cm$^3$, and a relative surface area of a particle is within a range of about 0.5 m$^2$/g to 4.5 m$^2$/g.

The used binder material is an acryl-based binder and its feature is as follows.

An acid value is within a range of about 10 mgKOH/g to 180 mgKOH/g, and a viscosity at about 24° C. to 25° C. is about 5000 cps to 45000 cps. A solid content is within a range of about 20 to 89 parts by weight, and a molecular weight (Mw) is within a range of about 1000 to 170000.

The used organic solvent is toluene, and its feature is as follows.

Density is within a range of about 0.8 g/ml to 0.99 g/ml, and a boiling point is within a range of about 180° C. to 290° C., a molecular weight is within a range of about 100 to 200, and its type is C—H—O.

The distribution stabilizer used as the additive is butyl acetate and its feature is as follows.

An acid value is within a range of about 7 mgKOH/g to 22 mgKOH/g, and a density at about 20° C. is about 0.8 g/ml to 1.1 g/ml, and a solid content is within a range of about 25 to 66 parts by weight.

The glass frit comprises parts by weight of $Bi_2O_3$, 20 parts by weight of $B_2O_3$, 11 parts by weight of $SiO_2$, 8 parts by weight of $Al_2O_3$, 4 parts by weight of BaO, 2 parts by weight of CaO, and 2 parts by weight of ZnO.

Referring in detail to Table 6, an exemplary embodiment 1 is a case where 70 parts by weight of metal powder, 18 parts by weight of binder, 4 parts by weight of organic solvent, 6 parts by weight of glass frit, and 2 parts by weight of additive are mixed to form an electrode material of a paste state, the formed electrode material is printed on a substrate using a blanket, and the printed electrode material is sintered to form an electrode.

A length of a cross section of an electrode formed according to an exemplary embodiment 1 is about 82.3 μm, and a peak height of the cross section is about 5.6 μm.

An exemplary embodiment 2 is a case where a metal powder of 80 parts by weight, a binder of 8 parts by weight, an organic solvent of 5 parts by weight, a glass frit of 5 parts by weight, and an additive of 2 parts by weight are mixed to form an electrode material of a paste state, the formed electrode material is printed on a substrate using a blanket, and the printed electrode material is sintered to form an electrode.

A length of a cross section of an electrode formed according to an exemplary embodiment 2 is about 80.1 μm, and a peak height of the cross section is about 5.4 μm.

An exemplary embodiment 3 is a case where a metal powder of 85 parts by weight, a binder of 5 parts by weight, an organic solvent of 5 parts by weight, a glass frit of 3 parts by weight, and an additive of 2 parts by weight are mixed to form an electrode material of a paste state, the formed electrode material is printed on a substrate using a blanket, and the printed electrode material is sintered to form an electrode.

A length of a cross section of an electrode formed according to an exemplary embodiment 3 is about 79.7 μm, and a peak height of the cross section is about 5.9 μm.

Referring to the exemplary embodiments 1, 2, and 3, it can be appreciated that if an electrode is manufactured in an offset print process by mixing respective components under the condition of an electrode composition according to the present invention, a feature of a length of a cross section of the electrode and a peak height of the cross section can be improved.

On contrary, the comparative example 1 is a case where a metal powder of 48 parts by weight, a binder of 8 parts by weight, an organic solvent of 39 parts by weight, a glass frit of 3 parts by weight, and an additive of 2 parts by weight are mixed to form an electrode material of a paste state, the formed electrode material is printed on a substrate using a blanket, and the printed electrode material is sintered to form an electrode.

A length of a cross section of an electrode formed according to the comparative example 1 is about 112.4 μm, and a peak height of the cross section is about 2.8 μm.

The comparative example 2 is a case where a metal powder of 92 parts by weight, a binder of 5 parts by weight, an organic solvent of 0.5 parts by weight, a glass frit of 2 parts by weight, and an additive of 0.5 parts by weight are mixed to form an electrode material of a paste state, the formed electrode material is printed on a substrate using a blanket, and the printed electrode material is sintered to form an electrode.

A length of a cross section of an electrode formed according to the comparative example 2 is about 59 μm, and a peak height of the cross section is about 8.4 μm.

Referring to the comparative examples 1 and 2, it can be appreciated that an excessive increase or an undue decrease of an organic solvent content may cause a difficulty in improving a feature of a length of a cross section of an electrode and a peak height of the cross section.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

The invention claimed is:

1. A display panel, comprising: a substrate; and an electrode disposed on the substrate, wherein a contact angle θ between the substrate and the electrode is expressed by the following Equation 1: arc tangent (T/S) ≦θ≦arc tangent (40T/S), wherein S is the surface area of electrode cross section and T is the peak height of electrode cross section.

2. The display panel of claim 1, wherein a contact angle θ between the substrate and the electrode is expressed by the following Equation 2: arc tangent(2T/S)≦θ≦arc tangent (20T/S).

3. The display panel of claim 1, wherein the contact angle θ between the substrate and the electrode lies substantially in a range between 3° and 45°.

4. The display panel of claim 3, wherein the contact angle θ between the substrate and the electrode lies substantially in a range between 5° and 30°.

5. The display panel of claim 1, wherein the length of the electrode cross section lies substantially in a range between 6 and 48 times than the peak height of the electrode cross section.

6. The display panel of claim 1, wherein the length of the electrode cross section lies substantially in a range between 11 and 22 times than the peak height of the electrode cross section.

7. The display panel of claim 1, wherein the width of the electrode cross section lies substantially in a range between 60 μm and 90 μm.

8. The display panel of claim 1, wherein the shape of the cross section of the electrode is convex-shape.

9. The display panel of claim 8, wherein the peak height of the electrode cross section lies substantially in a range between 3 μm and 10 μm.

10. The display panel of claim 1, wherein the electrical resistance of the electrode lies substantially in a range between 30Ω and 70Ω.

11. A display panel comprising:

a substrate; and an electrode disposed on the substrate, wherein a contact angle θ between the substrate and the electrode lies substantially in a range between 3° and 45°.

12. The display panel of claim 11, wherein the contact angle θ between the substrate and the electrode lies substantially in a range between 5° and 30°.

13. The display panel of claim 11, wherein the length of the electrode cross section lies substantially in a range between 6 and 48 times than the peak height of the electrode cross section.

14. The display panel of claim 11, wherein the length of the electrode cross section lies substantially in a range between 11 and 22 times than the peak height of the electrode cross section.

15. The display panel of claim 11, wherein the width of the electrode cross section lies substantially in a range between 60 μm and 90 μm.

16. The display panel of claim 11, wherein the shape of the cross section of the electrode is convex-shape.

17. The display panel of claim 16, wherein the peak height of the electrode cross section lies substantially in a range between 3 μm and 10 μm.

18. The display panel of claim 11, wherein the electrical resistance of the electrode lies substantially in a range between 30Ω and 70Ω.

* * * * *